US008029306B2

(12) United States Patent
Huang

(10) Patent No.: US 8,029,306 B2
(45) Date of Patent: Oct. 4, 2011

(54) PLUG MODULE

(75) Inventor: Pai-Ching Huang, Taipei (TW)

(73) Assignee: ASUSTeK Computer Inc., Taipei (TW)

( * ) Notice: Subject to any disclaimer, the term of this patent is extended or adjusted under 35 U.S.C. 154(b) by 0 days.

(21) Appl. No.: 12/715,382

(22) Filed: Mar. 2, 2010

(65) Prior Publication Data

US 2010/0248526 A1 Sep. 30, 2010

(30) Foreign Application Priority Data

Mar. 27, 2009 (TW) ..... 98110225 A

(51) Int. Cl.
*H01R 13/627* (2006.01)

(52) U.S. Cl. ..... 439/352

(58) Field of Classification Search ..... 439/352, 439/354, 257, 258, 347, 488, 489
See application file for complete search history.

(56) References Cited

U.S. PATENT DOCUMENTS 5,953,473 A * 9/1999 Shimotsu et al. ..... 385/56
6,447,170 B1 * 9/2002 Takahashi et al. ..... 385/53
6,514,099 B2 * 2/2003 Endo ..... 439/489
6,655,979 B1 * 12/2003 Lee ..... 439/357
6,994,581 B2 * 2/2006 Sung ..... 439/347
7,083,459 B1 8/2006 Wu et al.
7,252,531 B2 8/2007 Wu
7,318,740 B1 * 1/2008 Henry et al. ..... 439/352
7,322,845 B2 * 1/2008 Regnier et al. ..... 439/352
7,341,472 B2 * 3/2008 Chao et al. ..... 439/358
7,473,124 B1 * 1/2009 Briant et al. ..... 439/352
7,556,514 B1 * 7/2009 Sorensson et al. ..... 439/140
2003/0236018 A1 12/2003 Mimoto et al.
2006/0148300 A1 * 7/2006 Huang et al. ..... 439/353

* cited by examiner

*Primary Examiner* — Tulsidas Patel
*Assistant Examiner* — Harshad Patel
(74) *Attorney, Agent, or Firm* — Jianq Chyun IP Office

(57) ABSTRACT

A plug module disposed at the end of a cable is used for assembling in a socket, and the socket has a connecting portion and a position limiting structure on the connecting portion. The plug module includes a body, a positioning element, and a sliding element. The body is connected with the connecting portion in a connecting direction. The positioning element disposed on the body is interfered the position limiting structure. The sliding element is slidingly disposed at a side of the body adjacent to the cable, and it is suited for driving the positioning element to release the interference between the positioning element and the position limiting structure.

7 Claims, 6 Drawing Sheets

PLUG MODULE

CROSS-REFERENCE TO RELATED APPLICATION

This application claims the priority benefit of Taiwan application serial no. 98110225, filed on Mar. 27, 2009. The entirety of the above-mentioned patent application is hereby incorporated by reference herein and made a part of specification.

BACKGROUND OF THE INVENTION

1. Field of the Invention

The invention relates to a plug module and, more particularly, to a plug module convenient for a user to unplug.

2. Description of the Related Art

Along with the development of the computer technology and the variety of computer functions, various kinds of peripherals are developed. When a user disposes or removes the peripherals, unplugging various kinds of plugs in advance is always required. Since the connection between the plug and the socket is the most significant factor that considered while design, the plug is preferably designed to be firmly connected with the socket after plugging-in. Consequently, if the ease of removing the plug is not considered, many plugs may be difficult to be removed once they are plugging-in to the sockets.

A serial advanced technology attachment (SATA) plug is taken as an example herein. FIG. 1A is a top view showing a conventional plug module. FIG. 1B is a side view showing the plug module in FIG. 1A. As shown in FIG. 1A and FIG. 1B, the plug module 100 includes a body 110 and an elastic sheet 120, and the elastic sheet 120 has a plurality of protrusions 122. When the body 110 is connected with a socket 130, the protrusions 122 are fastened to a plurality of openings 132 on the socket 130, and thus the body 110 is firmly connected with the socket 130.

However, problems while removing the plug module 100 from the socket 130 are still exist. As shown in FIG. 1B, when the plug module 100 unplugged, the elastic sheet 120 is pressed to withdraw the protrusions 122 from the openings 132. Therefore, users have to apply force from the upper side of the plug module 100 to press the elastic sheet 120, however, once the space around the plug module 100 is occupied by other peripherals or other plugs, the plug module 100 is not easily removed from the socket 130.

BRIEF SUMMARY OF THE INVENTION

The invention provides a plug module easily to be plugged in and unplugged.

The invention provides a plug module disposed at an end of a cable and used for being assembled in a socket. The socket has a connecting portion and a position limiting structure thereon. The plug module includes a body, a positioning element, and a sliding element. The body is connected with the connecting portion of the socket along a connecting direction. The positioning element is disposed on the body and interfered with the position limiting structure. The sliding element is slidingly disposed at a side of the body adjacent to the cable and suited for driving the positioning element to release interference between the positioning element and the position limiting structure.

According to an embodiment of the invention, the sliding element slides between a first position and a second position relative to the body along the connecting direction. When the sliding element is at the first position, the sliding element drives the positioning element to release the interference between the positioning element and the position limiting structure. When the sliding element is at the second position, the sliding element is detached from the positioning element.

According to an embodiment of the invention, the plug module further includes a slip-proof element disposed on the body and at a sliding path of the sliding element.

According to an embodiment of the invention, the slip-proof element includes a rib horizontally disposed on the sliding path.

According to an embodiment of the invention, the plug module further includes a runner disposed between the sliding element and the body, wherein the sliding element slides relative to the body along the runner.

According to an embodiment of the invention, the positioning element includes at least one elastic element, each of the elastic elements is connected with the body and has a leaning portion and a positioning portion, and the leaning portion is between the positioning portion and the cable. When the body is connected with the connecting portion, the positioning portion interferes with the position limiting structure on the connecting portion. When the sliding element releases the interference between the positioning element and the position limiting structure, the sliding element is against the leaning portion.

According to an embodiment of the invention, the elastic element is an elastic rod, an end of the elastic rod is embedded and fixed in the body, and the body exposes the leaning portion and the positioning portion.

According to an embodiment of the invention, the positioning portion is a hook, and the position limiting structure includes an opening corresponding to the hook.

According to an embodiment of the invention, the elastic element is an elastic sheet, and an end of the elastic sheet is fixed on the body.

According to an embodiment of the invention, the positioning portion includes a plurality of protrusions, and the position limiting structure includes a plurality of the openings or recesses corresponding to the protrusions.

According to an embodiment of the invention, the body has a first fastening portion, the sliding element has a second fastening portion, and the first fastening portion is suited for being fastened to the second fastening portion.

According to an embodiment of the invention, the first fastening portion is a protrusion or a recess, and the second fastening portion is a recess or a protrusion.

According to an embodiment of the invention, a holding portion is extended from the sliding element toward to the cable.

As stated above, in the plug module according to the invention, when the body is connected with the connecting portion, the plug module is fixed in the socket via the interference between the positioning element on the body and the position limiting structure on the connecting portion. Additionally, the sliding element is against the positioning element via its sliding on the body to release the interference between the positioning element and the position limiting structure. Consequently, the user may plug and unplug the plug module in the socket by cooperating the sliding element of the plug module with the positioning element of the plug module. Therefore, the plug module according to the invention has considerable convenience and practicability.

These and other features, aspects and advantages of the present invention will become better understood with regard to the following description, appended claims, and accompanying drawings.

DETAILED DESCRIPTION OF THE EMBODIMENTS

Figure 2A:
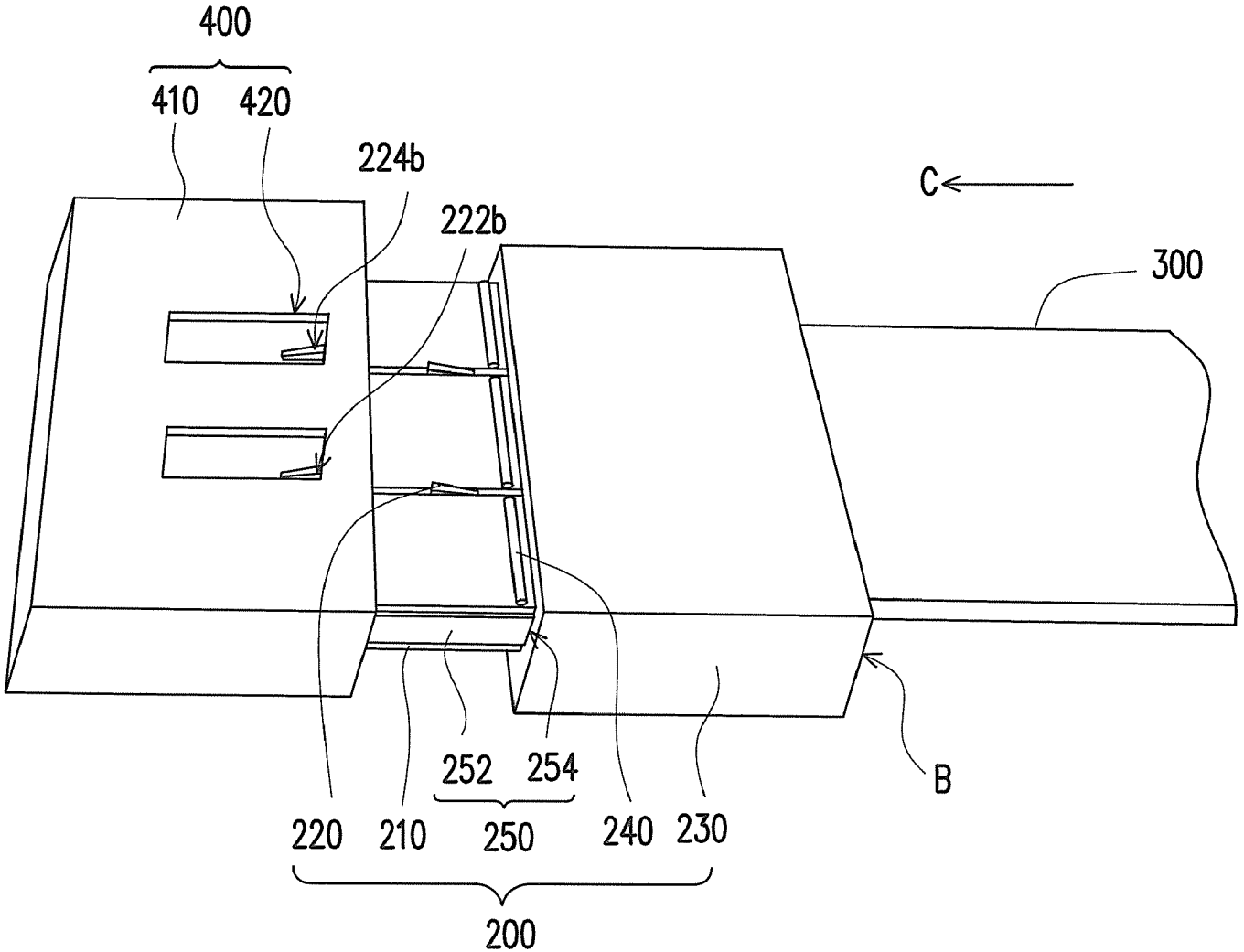
FIG. 2A is a schematic diagram showing a plug module according to an embodiment of the invention.
Figure 2B:
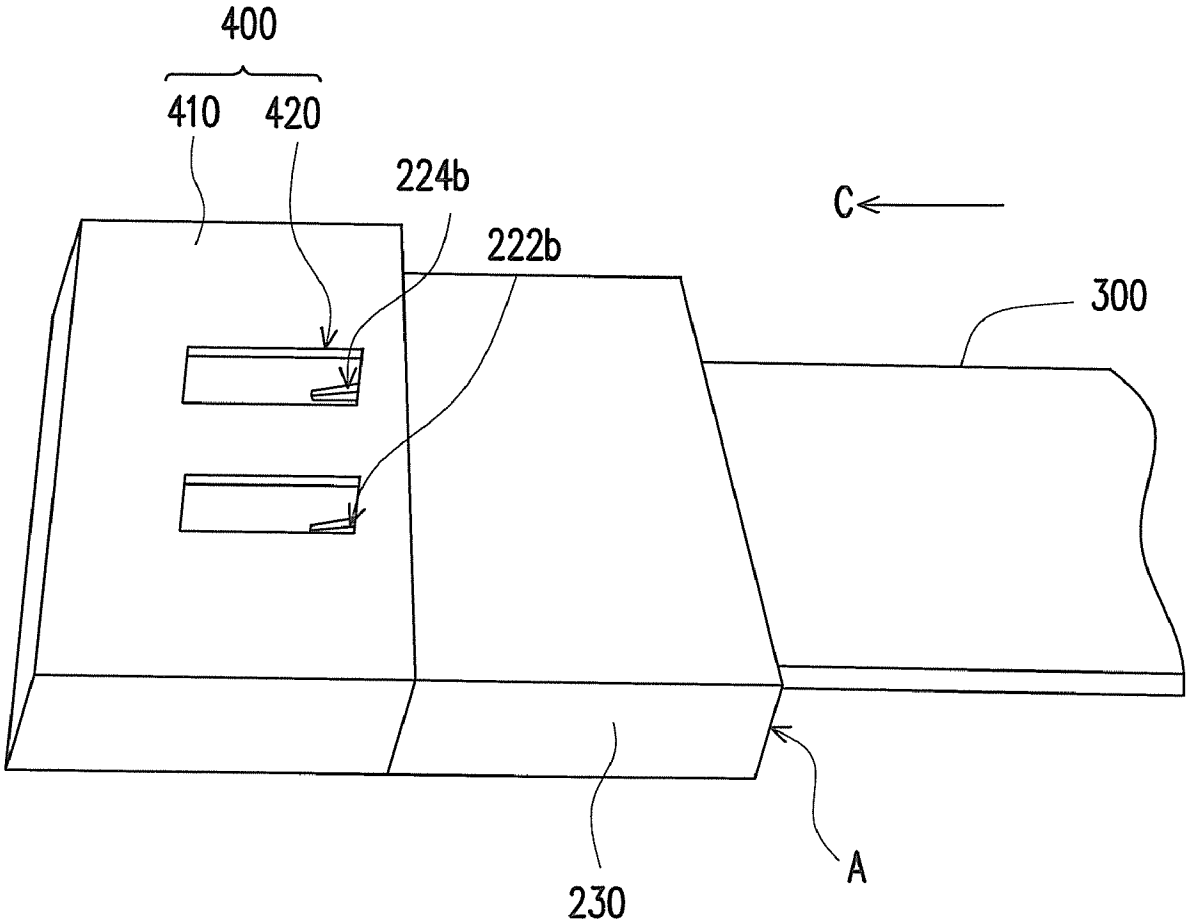
FIG. 2B is a schematic diagram showing that a sliding element of the plug module in FIG. 2A is at a second position.

FIG. 2A is a schematic diagram showing a plug module according to an embodiment of the invention. FIG. 2B is a schematic diagram showing that a sliding element of the plug module in FIG. 2A is at a second position. As shown in FIG. 2A and FIG. 2B, a plug module 200 is disposed an end of a cable 300, and it is used for being plugged in a socket 400 to make the cable 300 electrically connected with the socket 400. The socket 400 has a connecting portion 410 and a position limiting structure 420 on the connecting portion 410. In this embodiment, the plug module 200 may be a male plug of a connector, and the socket 400 may be a female plug of the connector. In another embodiment not shown in the drawings, the plug module may be the female plug of the connector, and the socket may be the male plug of the connector. The forms of the plug module 200 and the socket 400 are not limited in the invention.

The plug module 200 includes a body 210, a positioning element 220, and a sliding element 230. The body 210 is connected with the connecting portion 410 of the socket 400 along a connecting direction C. The positioning element 220 is disposed on the body 210 and interfered the position limiting structure 420. The sliding element 230 is slidingly disposed at the body 210 adjacent to the cable 300, and it is suited for driving the positioning element 220 to release the interference between the positioning element 220 and the position limiting structure 420.

Figure 1A:
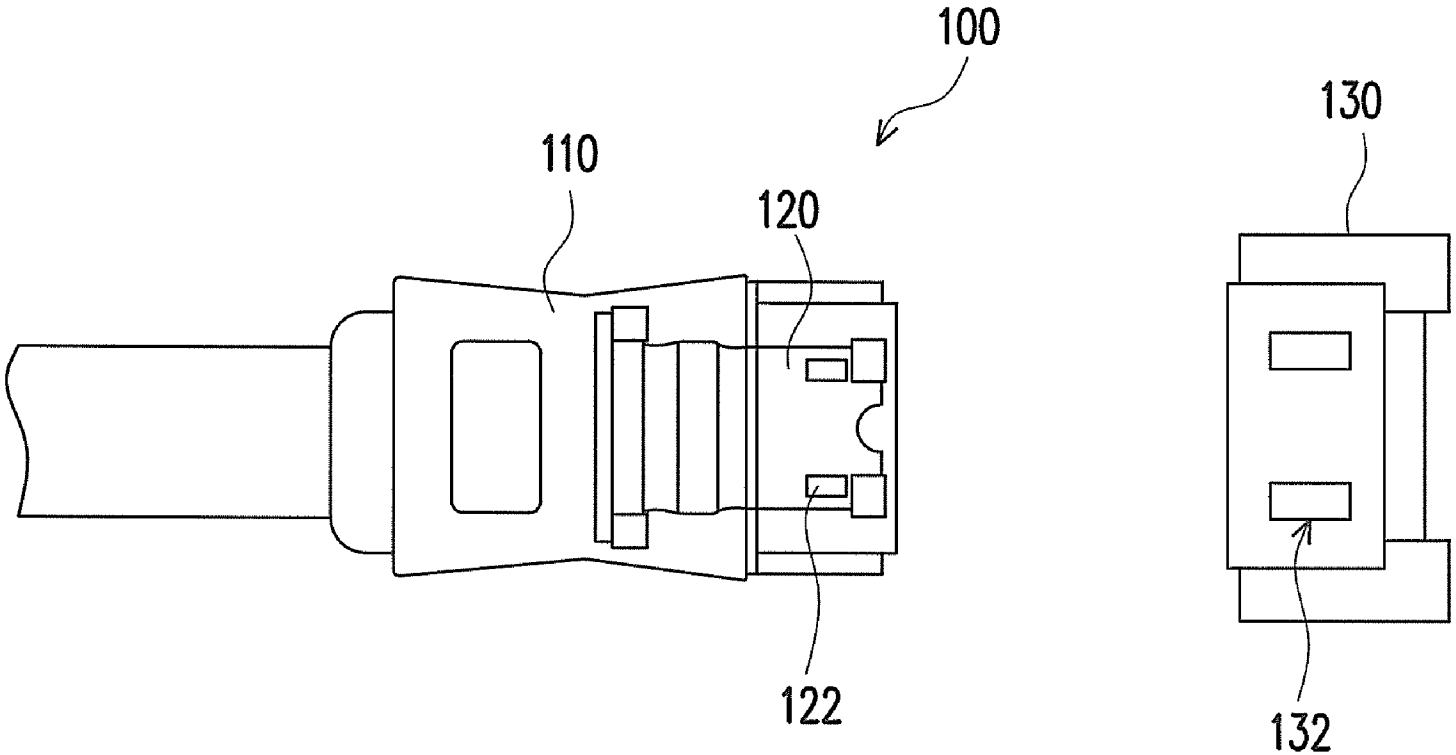
FIG. 1A (RELATED ART)
FIG. 1A is a top view showing a conventional plug module.
Figure 1B:
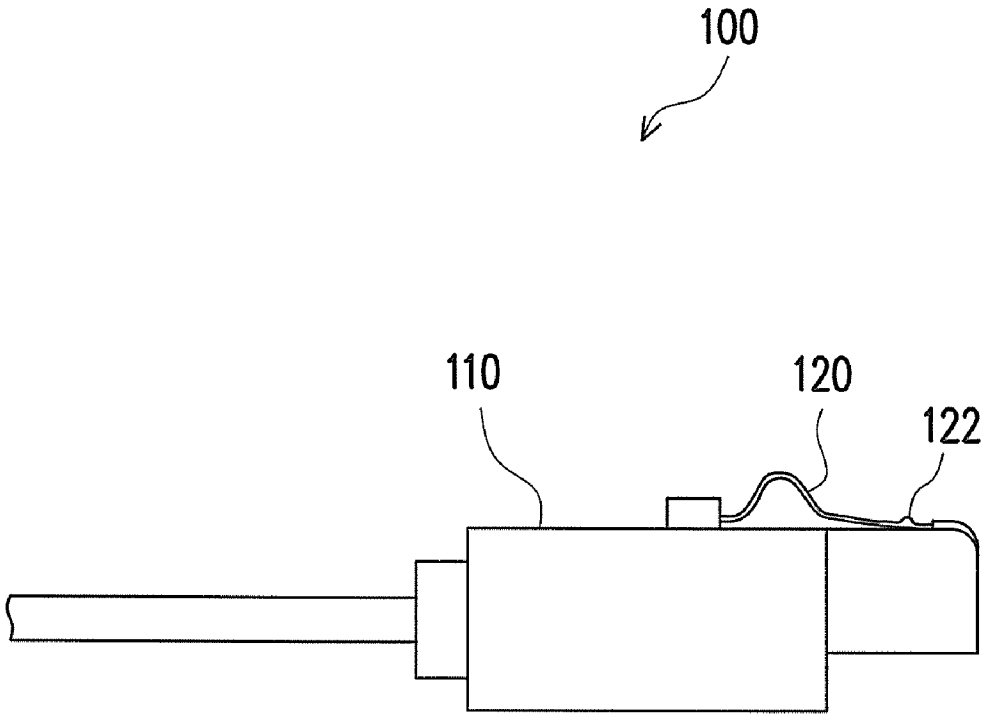
FIG. 1B (RELATED ART)
FIG. 1B is a side view showing the plug module in FIG. 1A.

In the plug module 200 according to the embodiment of the invention, due to the cooperation between the positioning element 220 and the sliding element 230, the position limiting structure 420 interferes the positioning element 220 structurally to fix the plug module 200 in the socket 400 when the connecting portion 410 is connected with the body 210, and the sliding element 230 may be against and drives the positioning element 220 to release the interference between the positioning element 220 and the position limiting structure 420 by sliding on the body 210. As a result, unlike the conventional technology shown in FIG. 1A, the user does not need to apply the force in a specific direction and even utilize an auxiliary tool to detach the plug module 100 from the socket 130.

As shown in FIG. 2A and FIG. 2B, the sliding element 230 slides between a first position A and a second position B relative to the body 210 along the connecting direction C. When the sliding element 230 is at the first position A, it is against the positioning element 220, and it drives the positioning element 220 to release the interference between the positioning element 220 and the position limiting structure 420 to allow the user to remove the plug module 200 from the socket 400. When the sliding element 230 is at the second position B, the sliding element 230 is detached from the positioning element 220.

As shown in FIG. 2A, the plug module 200 further includes a slip-proof element 240 disposed on the body 210 and a sliding path for the sliding element 230 sliding on the body 210. In this embodiment, the slip-proof element 240 may be a rib horizontally disposed on the sliding path, and it is used for providing the force for blocking the sliding element 230 from sliding from the second position B to the first position A, and thus the sliding element 230 is maintained at the second position B when it is not subjected to a force. Once the user wants to unplug the plug module 200 from the socket 400, he or she only needs to apply the force on the sliding element 230 to make the sliding element 230 overcome resistance from the slip-proof element 240. Then, the sliding element 230 slides from the second position B to the first position A, and it is against the positioning element 220 and drives the positioning element 220 to release the interference between the positioning element 220 and the position limiting structure 420. Thus, the plug module 200 may be unplugged from the socket 400 by the user.

In this embodiment, the plug module 200 further includes a runner 250 disposed between the sliding element 230 and the body 210 to allow the sliding element 230 to slide relative to the body 210 via the runner 250. The runner 250 may be formed by cooperating a strip-shaped protrusion 252 disposed on the body 210 with a groove 254 formed on the sliding element 230. However, the form of the runner 250 is not limited in the invention. In another embodiment of the invention not shown in the drawings, the runner may be formed by cooperating the groove formed on the body 210 with the strip-shaped protrusion disposed on the sliding element 230.

Figure 3:
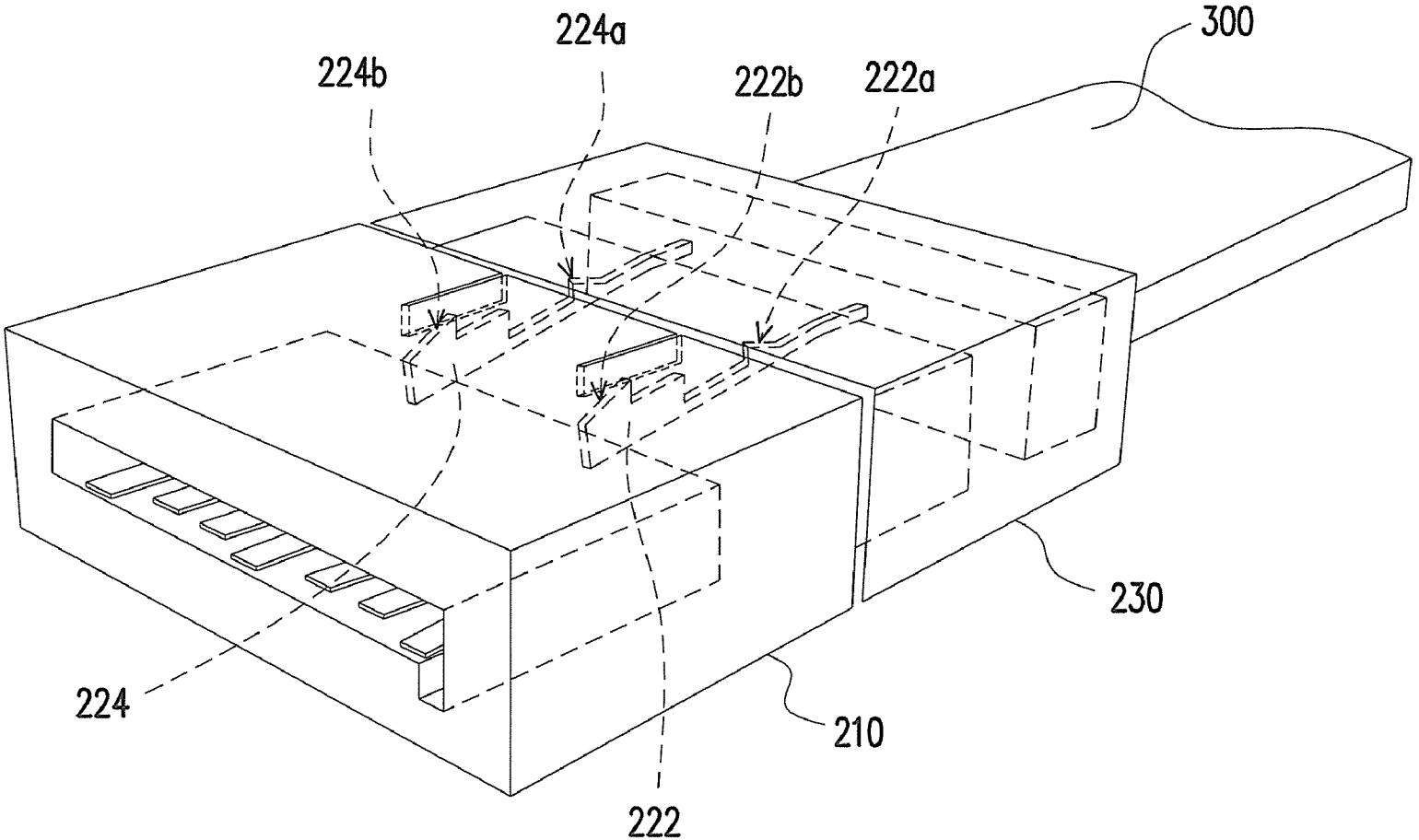
FIG. 3 is a perspective view showing the plug module in FIG. 2B.

FIG. 3 is a perspective view showing the plug module in FIG. 2B. As shown in FIG. 3, in this embodiment, the positioning element 220 includes two elastic elements 222 and 224, and the elastic elements 222 and 224 are connected with the body 210 and have leaning portions 222*a* and 224*a* and positioning portions 222*b* and 224*b*, respectively. The leaning portions 222*a* and 224*a* are between the positioning portions 222*b* and 224*b* and the cable 300. In this embodiment, the elastic elements 222 and 224 may be elastic rods, an end of each of them is embedded and fixed in the body 210, and the body 210 exposes the leaning portions 222*a* and 224*a* and the positioning portions 222*b* and 224*b*.

As shown in FIG. 2A and FIG. 3, in this embodiment, the positioning portions 222*b* and 224*b* may be hooks, and the position limiting structure 420 on the connecting portions 410 may be openings or recesses. When the body 210 is connected with the connecting portion 410, the positioning portions 222*b* and 224*b* interfere the position limiting structure 420 structurally. In other words, the hooks are fastened to the opening at the time, and thus the plug module 200 is fixed in the socket 400. Moreover, when the sliding element 230 is at the first position A, the sliding element 230 is against the leaning portions 222*a* and 224*a* to make the leaning portions 222*a* and 224*a* sunk into the body 210 and drive the positioning portions 222*b* and 224*b* to withdraw from the position limiting structure 420 at the same time. That is, the hook is withdrawn from the opening. The user may unplug the plug module 200 from the socket 400 at the moment.

Figure 4:
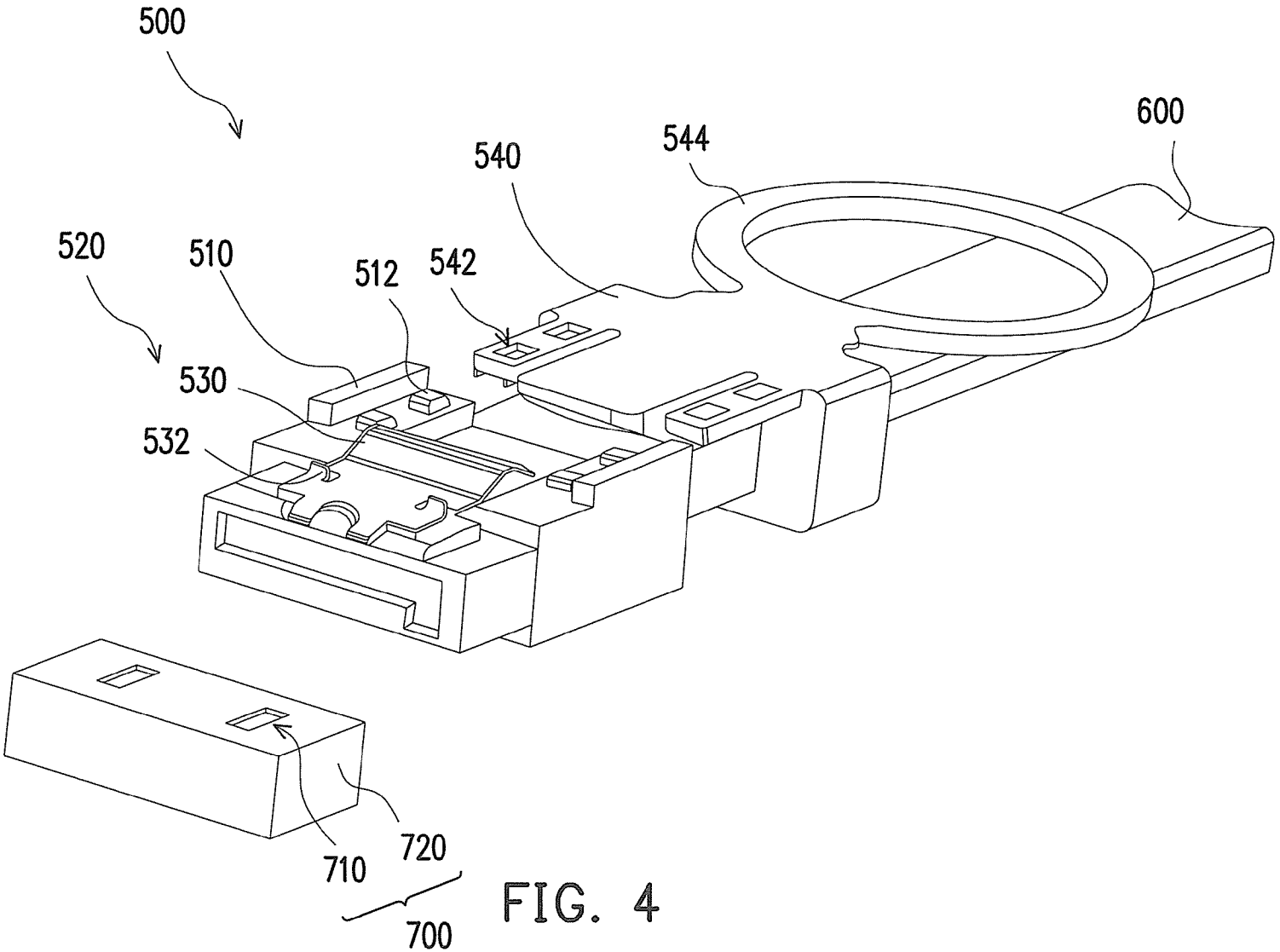
FIG. 4 is a schematic diagram showing a plug module according to another embodiment of the invention.

FIG. 4 is a schematic diagram showing a plug module according to another embodiment of the invention. As shown in FIG. 4, the difference between this embodiment and the above embodiment is that the positioning element 520 in this embodiment includes an elastic element 530. The elastic element 530 may be an elastic sheet, an end of the elastic element 530 is fixed on the body 510. Additionally, positioning portions 532 on the elastic element 530 may be a plurality of the protrusions, position limiting structures 710 of a socket 700 may be a plurality of the openings corresponding to the protrusions to make the positioning portions 532 fastened in the position limiting structures 710 when the body 510 is connected with a connecting portion 720 of the socket 700. The forms of the positioning portions 532 and the position limiting structure 710 are not limited herein, and any structure capable of making the positioning element 520 fastened to the connecting portion 720 is in the scope of the invention.

Additionally, in this embodiment, the body 510 has first fastening portions 512 such as a plurality of the protrusions, and the sliding element 540 has second fastening portions 542 such as a plurality of the openings. When the sliding element 540 is at the second position B, the first fastening portions 512 are fastened to the second fastening portions 542. As a result, the sliding element 540 can be fixed on the body 510 and against the positioning element 520 at the same time. Additionally, the sliding element 540 further has a holding portion 544 extended from the sliding element 540 toward a cable 600, and the holding portion 544 is used for being held by the user. Consequently, the user may push the sliding element 540 to the second position B to release the interference between the positioning element 520 and the position limiting structure 710 via the holding portion 544. Then, the user applies the force on a plug module 500 or a cable 600 via the holding portion 544 to unplug the plug module 500 from the socket 700.

To sum up, since the plug module according to the invention has the positioning element and the sliding element sliding on the body, when the plug module is connected with the socket, the positioning portion of the positioning element interferes the position limiting structure of the socket structurally to make the plug module fixed in the socket. Additionally, the plug module further includes the slip-proof element horizontally disposed on the body and the sliding path of the sliding element to block the sliding element from sliding toward the positioning element, and the slip-proof element is used as a protection device preventing the plug module form being detached from the socket.

Additionally, when the user wants to plug the plug module from the socket, he or she slides the sliding element to a proper position, and thus the sliding element is against the leaning portion to drive the positioning portion to withdraw from the position limiting structure of the connecting portion to release the interference between the positioning element and the position limiting structure. As a result, unlike the conventional technology, the user does not need to apply the force in the specific direction and even utilize the auxiliary tool to detach the plug module from the socket. Consequently, the plug module according to invention has considerable convenience and practicability.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A plug module, disposed at an end of a cable and used for being assembled in a socket, the socket has a connecting portion and a position limiting structure on the connecting portion, the plug module comprising:

a body, connected to the connecting portion of the socket along a connecting direction;

a positioning element, disposed on the body and interfered the position limiting structure, wherein the positioning element comprises at least one elastic element, each of the elastic elements is connected with the body and has a leaning portion and a positioning portion, and the leaning portion is between the positioning portion and the cable, wherein the elastic element is an elastic rod, an end of the elastic rod is embedded and fixed in the body, and the body exposes the leaning portion and the positioning portion; and a sliding element slidingly disposed at a side of the body adjacent to the cable and suited for driving the positioning element to release interference between the positioning element and the position limiting structure.

2. The plug module according to claim 1, wherein the sliding element slides between a first position and a second position relative to the body along the connecting direction, when the sliding element is at the first position, the sliding element drives the positioning element to release the interference between the positioning element and the position limiting structure, and when the sliding element is at the second position, the sliding element is detached from the positioning element.

3. The plug module according to claim 1, further comprising a slip-proof element disposed on the body and at a sliding path of the sliding element.

4. The plug module according to claim 3, wherein the slip-proof element comprises a rib horizontally disposed on the sliding path.

5. The plug module according to claim 1, further comprising a runner disposed between the sliding element and the body, wherein the sliding element slides relative to the body along the runner.

6. The plug module according to claim 1, wherein the positioning portion is a hook, and the position limiting structure comprises an opening corresponding to the hook.

7. The plug module according to claim 1, wherein a holding portion is extended from the sliding element toward the cable.

* * * * *